US006316872B1

(12) United States Patent
Ge et al.

(10) Patent No.: US 6,316,872 B1
(45) Date of Patent: Nov. 13, 2001

(54) COLD CATHODE FLUORESCENT LAMP

(75) Inventors: Xiaoqin Ge, Wenerjie (CN); Shichao Ge, San Jose; Victor Lam, Saratoga, both of CA (US); Yiping Ge, San Jose, CA (US)

(73) Assignee: GL Displays, Inc., Saratoga, CA (US)

( * ) Notice: Subject to any disclaimer, the term of this patent is extended or adjusted under 35 U.S.C. 154(b) by 0 days.

(21) Appl. No.: 09/188,035

(22) Filed: Nov. 6, 1998

Related U.S. Application Data

(63) Continuation-in-part of application No. 09/073,738, filed on May 6, 1998, which is a continuation-in-part of application No. 08/532,077, filed on Sep. 22, 1995, now Pat. No. 5,834,889.

(51) Int. Cl.[7] ..... H01J 17/00
(52) U.S. Cl. ..... 313/493; 313/573; 313/317
(58) Field of Search ..... 313/493, 113, 313/312, 317, 318.01, 318.12, 318.08, 495, 573

(56) References Cited

U.S. PATENT DOCUMENTS

| | | |
|---|---|---|
| D. 334,242 | 3/1993 | Imamura et al. . |
| D. 334,990 | 4/1993 | Sekiguchi et al. . |
| 2,171,359 | 4/1939 | Gertler . |
| 4,029,984 | 6/1977 | Endriz . |
| 4,425,608 | 1/1984 | Hecker et al. . |
| 4,558,400 | 12/1985 | Buser . |
| 4,625,152 | 11/1986 | Nakai . |
| 4,750,096 | 6/1988 | Lin . |
| 4,767,193 | 8/1988 | Ota et al. . |
| 4,839,564 | 6/1989 | Ide et al. . |
| 4,937,487 | 6/1990 | Blaisdell et al. . |
| 5,019,749 | 5/1991 | Ito . |
| 5,032,765 | 7/1991 | Nilssen . |
| 5,061,872 | 10/1991 | Kukla . |
| 5,191,259 | 3/1993 | Hayashi et al. . |
| 5,216,324 | 6/1993 | Curtin . |
| 5,220,249 | 6/1993 | Tsukada ..... 315/246 |
| 5,337,068 | 8/1994 | Stewart et al. . |

(List continued on next page.)

FOREIGN PATENT DOCUMENTS

| | | |
|---|---|---|
| 1123945 | 6/1996 | (CN) . |
| 95116709 | 3/1997 | (CN) . |
| 0151850A | 8/1985 | (EP) . |
| 0213560A | 3/1987 | (EP) . |
| 0331660 | 9/1989 | (EP) . |
| 0348979A | 1/1990 | (EP) . |
| 0593311A | 4/1994 | (EP) . |
| 1485166A | 9/1977 | (GB) . |
| 2261332A | 5/1993 | (GB) . |
| 60041750A | 3/1985 | (JP) . |
| 62157657 | 7/1987 | (JP) . |
| 01315787 | 12/1989 | (JP) . |
| 03264990A | 11/1991 | (JP) . |
| 07114904A | 5/1995 | (JP) . |
| WO9429895A | 12/1994 | (WO) . |
| WO9522835 | 8/1995 | (WO) . |

*Primary Examiner*—Ashok Patel
(74) *Attorney, Agent, or Firm*—Skjerven. Morrill MacPherson LLP

(57) ABSTRACT

A light transmitting container is used to house a cold cathode fluorescent lamp (CCFL) to reduce heat loss and to increase the luminous efficiency of the lamp. An electrical connector configuration is connected to an electrode of the lamp and adapted to be electrically and mechanically connected to a conventional electrical socket. A driver circuit in the container converts 50 or 60 Hz power to the high frequency power suitable for operating the CCFL. At least one of the electrodes of the CCFL is outside of the container to facilitate heat dissipation. A CCFL having an elongated tube portion and enlarged portions for housing larger electrodes is proposed to enhance the longevity and brightness of the CCFL. Larger electrodes are used to generate more electrons in the CCFL, thereby generating more light. Larger electrodes also reduces the temperature of the tube material of the CCFL to enhance the lifetime of the device.

16 Claims, 6 Drawing Sheets

U.S. PATENT DOCUMENTS 5,387,837 2/1995 Roelevink et al. .
5,455,484 10/1995 Maya et al. .
5,457,312 10/1995 Mansour .
5,466,990 11/1995 Winsor .
5,502,626 3/1996 Armstrong et al. .
5,514,934 5/1996 Matsumoto et al. .
5,668,443 9/1997 Kawaguchi et al. .

COLD CATHODE FLUORESCENT LAMP

CROSS REFERENCE TO RELATED APPLICATION

This application is a continuation-in-part of copending application Ser. No. 09/073,738, filed May 6, 1998, which is a continuation-in-part of application Ser. No. 08/532,077, filed Sep. 2, 1995 now U.S. Pat. No. 5,834,889.

BACKGROUND OF THE INVENTION

1. Field of the Invention

This invention relates in general to a cold cathode fluorescent lamp device, and in particular, to a high luminance, high efficiency, long lifetime monochromatic, multi-color or full-color cold cathode fluorescent lamp devices (CFD).

2. Description of the Prior Art

Hot cathode fluorescent lamps (HCFLs) have been used for illumination. The HCFL operates in the arc gas discharge region. It operates at a relatively low voltage (of the order of 100 volts), large current (in the range of 60 milliamps), high efficiency (such as 80 lm/W, and the cathode is usually operated at a relatively high temperature such as 400 C. Typically, the cathodes would first need to be heated to an elevated temperature by means of a starter and a ballast before the HCFL may be turned on and operated at its optimum temperature. Thus, in order to turn on an HCFL, a voltage is applied to the starter which generates gas discharge. The heat produced by the gas discharge heats up the cathode and an electron emission layer on the cathode to an elevated temperature so that the layer emits electrons to maintain the gas discharge. The gas discharge generates ultraviolet radiation which causes a phosphor layer in the lamp to emit light.

When the cathode and the electron emission layer are first heated to an elevated temperature during starting, the heating causes a portion of the electron emission layer to evaporate, so that after the HCFL has been started a number of times, the electron emission layer may become deficient for the purpose of generating electrons, so that the HCFL needs to be replaced. This problem is particularly acute for displaying information that requires constant starting and turning off the HCFLs. Thus, HCFLs are not practical for use in computer, video, and television applications. For the purpose of illumination, HCFLs requires starters and ballasts, which may also become defective after a period of constant use. This also reduces the lifetime of the HCFL. It is thus desirable to provide an illumination device with improved characteristics.

Currently available traffic light and outdoor large size sign displays are normally made of incandescent lamps. They have high brightness, but many drawbacks:

a. High maintenance cost because of short lifetime and low reliability. This is the case especially for traffic lights or signs on free ways, where changing and repair of the lights are very inconvenient and expensive.

b. High power consumption because of low luminous efficiency, which is about 10 lm/W. For traffic lights and other multi-colored displays, luminance efficiency is even lower because colored light is obtained by filtering white light emitted from the incandescent lamps, so that the colored fight so obtained is much reduced in intensity. The effective efficiency for such applications is only 4 lm/W or lower.

c. Under direct sunight, ON/OFF contrast is very low, i.e., even OFF status looks like ON, which can cause fatal results.

It is, therefore, desirable to provide an improved illumination device which avoids the above-described disadvantages.

SUMMARY OF THE INVENTION

The present invention has been made in view of the foregoing disadvantages of the prior art.

In one aspect of the invention, a light transmitting container containing a gas medium is used to house at least one cold cathode fluorescent lamp ("CCFL"). The gas medium and the container increase luminous efficiency of the at least one lamp by reducing heat lost from the lamp and the effect of the ambient temperature on the lamp.

In another aspect of the invention, a light transmitting container is used to house at least one cold cathode fluorescent lamp having at least one electrode. The container increases the luminous efficiency of the lamp by reducing heat loss from and the effect of ambient temperature on the lamp. An electrical connector connected to the at least one electrode is adapted to be electrically and mechanically connected to one of a number of conventional electrical sockets. In this manner, a gas discharge device formed by the above elements may be used to replace a conventional incandescent lamp.

According to yet another aspect of the invention, a light transmitting container is used to house at least one cold cathode fluorescent lamp having at least one electrode so as to increase the luminous efficiency of the lamp by reducing heat loss from and the effect of the ambient temperature on the lamp. A driver circuit in the container is connected to the at least one electrode to supply power to the lamp. The container containing the lamp and the driver circuit, therefore, form a complete gas discharge device that may be used to replace a conventional incandescent lamp.

According to one more aspect of the invention, a light transmitting container is used to house at least one elongated cold cathode fluorescent lamp having two ends so as to increase the luminous efficiency of the lamp by reducing heat loss from and the effect of the ambient temperature on the lamp. A base plate is used to support the lamp at or near the two ends at two support locations and the base plate is attached to the container. Support means is used to connect a portion of the lamp at a location between the two support locations to the container to secure the lamp to the container. By supporting the lamp at a location between the two support locations, the lamp is less likely to be damaged by vibrations, such as those present in a traveling vehicle.

According to yet another aspect of the invention, a container is used to house at least one cold cathode fluorescent lamp so as to increase luminous efficiency of the lamp by reducing heat loss from and the effect of the ambient temperature on the lamp. The at least one lamp has at least one electrode outside the container. Since the container reduces heat loss from the lamp, if none of the electrodes of the at least one lamp is outside the container, the heat generated by the electrodes would cause the temperature of the lamp to become elevated, thereby reducing the luminous efficiency of the lamp. By placing at least one electrode outside the container, the temperature of the lamp is less likely to become elevated.

In yet another aspect of the invention, a CCFL is proposed comprising a tube that has an elongated portion and an enlarged portion with cross-sectional dimensions larger than those of the elongated portion, in order to accommodate larger size electrodes. The larger size electrodes can be used to provide a higher quantity of electrons in the CCFL, thereby resulting in the higher brightness of the device. Larger size electrodes also reduce the amount of heat generated, thereby enhancing the lifetime of the device.

BRIEF DESCRIPTION OF THE DRAWINGS

Other objects and many of the attendant advantages of the present invention will be readily appreciated as the same becomes better understood by reference to the following detailed description when considered in connection with the accompanying drawings, wherein:

FIGS. 9(*b*), 9(*c*) illustrate two possible shapes of CCFLs that may be used in the device of FIG. 9(*a*).

FIGS. 11(*b*), 11(*c*) are respectively cross-sectional views along the line 11(*b*), 11(*c*)–11(*b*), 11(*c*) in FIG. 11(*a*), illustrating two different implementations of the embodiment of FIG. 11(*a*).

For simplicity in description, identical components are labeled by the same numerals in this application.

DETAILED DESCRIPTION OF THE PREFERRED EMBODIMENTS

The invention of this application may be used for illumination and for display of information.

The present invention may be used to provide high luminous efficiency, low power consumption with long lifetime of up to 20,000 hours or more at high luminance operating conditions. The luminous efficiency can be up to 30 lm/W or more.

CCFLs are operated at high frequencies at the order of tens of kHz and in the range of 900 to 1,500 volts. When the CCFLs are not emitting light, higher voltages need to be applied to costly lamps to start light emission, where such starting voltages are typically at the higher end of the 900 to 1,500 volts range. After the CCFLs have been caused to start emitting light, light emission may be sustained by applying voltages lower than the starting voltage, typically voltages towards the lower end of the range of about 900 to 1,500 volts.

One type of cold cathode fluorescent lamp has two electrodes, both located inside a tube which contains mercury and some inert gas such as neon, argon or helium. This type of cold cathode fluorescent lamp functions in the glow gas discharge region. It operates at high voltage (of the order of several hundred volts), low current (several milliamperes) and at a relatively high temperature (30 to 75° C., optimum at about 60° C., cathode operating in a temperature of about 150 to 190° C.). It has a high efficiency of about 40 to 50 lumens per watt. The excitation of mercury is used to generate ultraviolet light and the ultraviolet light generated by mercury impinges on the fluorescent material on the inside of the tube in order to generate visible light. In this type of CCFL, the inert gas is present in the tube not to generate ultraviolet light but to impede the movement of mercury atoms and to increase the probability of collision ionization of mercury atoms between the electrodes so as to increase the amount of ultraviolet light generated by mercury atoms during their passage between the two electrodes.

Figure 1:
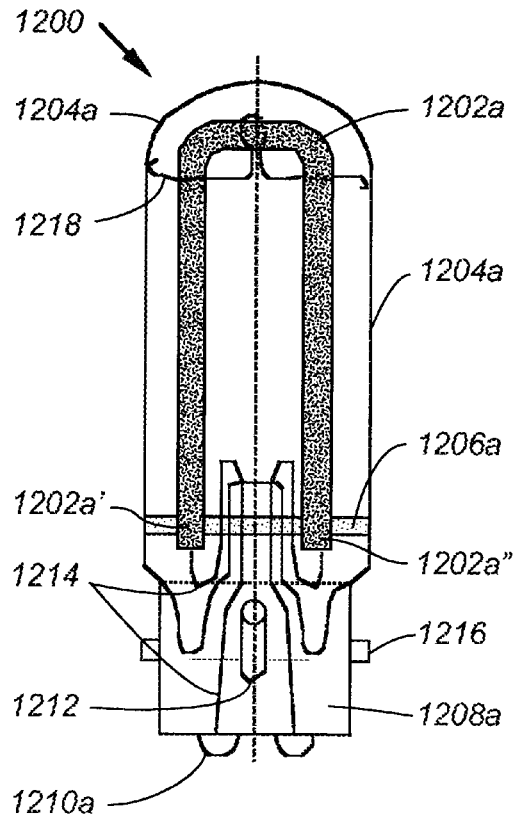
FIG. 1 is a schematic view of a cold cathode gas discharge illumination device suitable for use to replace a conventional incandescent lamp, where support means is employed to prevent the CCFL from excessive vibrations or hitting a container to illustrate an embodiment of the invention. The device of FIG. 1 has an electrical connector that would fit into conventional two prong type electrical sockets.

The description below in reference to FIGS. 1–4, 6–8 pertain to CCFLs used as illumination devices. Thus, it is desirable for the containers in these figures for housing the lamps in these devices to be light transmitting and to surround the lamps so that the lamps emit light in substantially all directions except for perhaps a small area needed to support the lamps, from which area light may be reflected instead. In other words, the containers themselves preferably would include no reflecting surfaces. As shown in FIG. 1, illumination device 1200 includes a CCFL 1202*a* enclosed within a container 1204*a* which can be made of any light transmitting material such as glass or plastic. The CCFL 1202*a* is elongated and has two ends 1202*a*' and 1202*a*". The CCFL 1202*a* is held in place by a base plate 1206*a*, where the two ends 1202*a*', 1202*a*" of the CCFL are inserted into matching holes in the base plate, and the base plate is attached at its edge to the inner wall of container 1204*a* by an adhesive such as a ceramic adhesive in a manner as that described above. Container 1204*a* is attached to a lamp holder 1208*a*. Attached to lamp holder 1208*a* are two electric connectors 1210*a*. Lamp holder 1208*a* is also provided with two fingers or protrusions 1216 adapted to fit into notches (not shown) in a conventional spring loaded electrical socket (not shown), such as those typically used for incandescent lamps; such conventional sockets are also known as two prong sockets. With the connectors 1210*a* and lamp holder 1208*a* with fingers 1216 configured as shown in FIG. 1, the illumination device 1200 is adapted to fit into the spring loaded type of conventional electrical sockets which have notches into which fingers 1216 fit. In this manner, illumination device 1200 may be used to replace conventional incandescent lamps in conventional electrical sockets, without having to alter the configuration of the socket.

Where container 1204*a* is to be evacuated to result in a vacuum chamber, this can be performed through exhaust tube 1212. As described above, by placing CCFL 1202*a* in the vacuum chamber, heat lost from the CCFL can be reduced to maintain the CCFL at an elevated temperature, such as a temperature within the range of 30–75° C., which would improve the luminous efficiency and lifetime of the CCFL. Alternatively, a gas such as an inert gas may be injected into the chamber and enclosed by container 1204*a*. In such event, it is preferable for a small hole, e.g. through the exhaust tube 1212, to be maintained between the chamber enclosed by container 1204*a* and the atmosphere so that expansion and contraction of the gas due to temperature changes will not damage the container. By placing CCFL 1202*a* in the enclosed gas in the container 1204*a*, heat lost from the CCFL can be reduced to maintain the CCFL at an elevated temperature, such as a temperature within the range of 30–75° C., which would improve the luminous efficiency and lifetime of the CCFL.

Since the CCFL 1202*a* is elongated, if the device 1200 is used in a transport vehicle, device 1200 may be subject to vibrations. When device 1200 is used in, for example, an airplane, such vibrations can be of high amplitude. For this reason, it may be desirable to employ a support means, such as a spring 1218 connecting preferably a mid-portion of the CCFL to the inner walls of the container 1204*a*, so that vibrations of device 1200 will not cause the CCFL to be subject to inordinate strain or hit the container. It may be adequate for the spring 1218 to be simply in contact with container 1204*a*, and it may be adequate for spring 1218 to connect to the inner wall of the container a portion of the CCFL located away from the mid-portion of the CCFL but still between the two ends.

Figure 2:
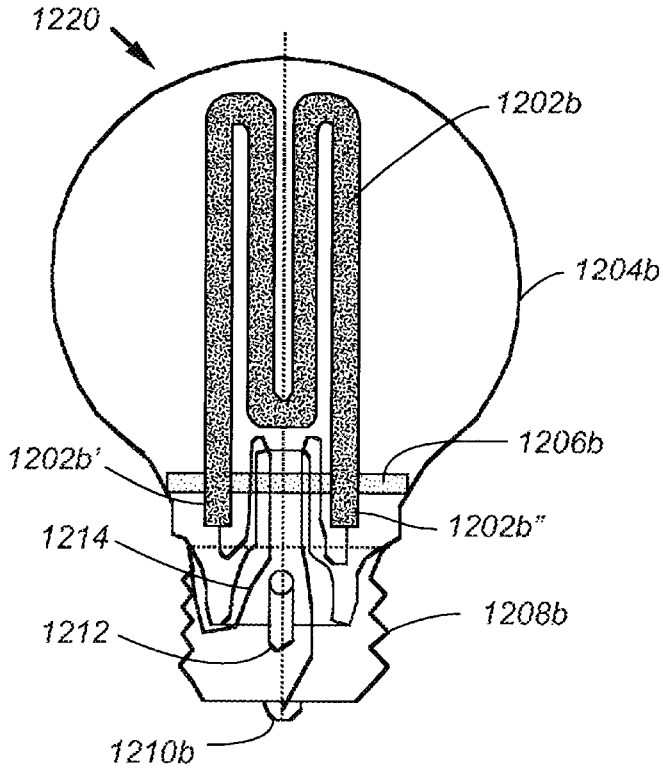
FIG. 2 is a schematic view of a cold cathode gas discharge illumination device with an electrical connector that would fit into conventional spiral type electrical sockets to illustrate another embodiment of the invention.

FIG. 2 illustrates another configuration of an illumination device which may be used to replace commonly used incandescent lamps. A CCFL 1202*b* is enclosed within a container 1204*b* which is generally spherical in shape, as opposed to the elongated or cylindrical shape of container 1204*a* in FIG. 1.

As in FIG. 1, the two ends 1202*b*', 1202*b*" of the CCFL are inserted into matching holes in the base plate 1206*b* which, in turn, is glued to the inner wall of container 1204*b* in a manner as described above in reference to FIG. 1. Attached to container 1204*b* is a lamp holder 1208*b* designed to fit into a conventional electrical socket having a spiral-shaped connector. Lamp holder 1208*b* is shaped to also have a spiral-shaped outside electrically conductive surface to fit into the spiral-type conventional electrical sockets. Electrical connector 1210*b* is adapted to contact the matching or corresponding electrical connector in the bottom portion a conventional spiral-type electrical socket (not shown). Again the chamber in container 1204*b* may be evacuated by means of exhaust tube 1212, or an inert gas may be injected there through. Electrical connectors, such as wires 1214, connect the CCFL to the electrical connector 1210*b* and the other electrical connector on the spiral surface of holder 1208*b*. Thus, illumination device 1220 may again be used to replace incandescent lamps to fit into spiral-type conventional electrical sockets, without having to change the configuration of the socket.

Figure 3:
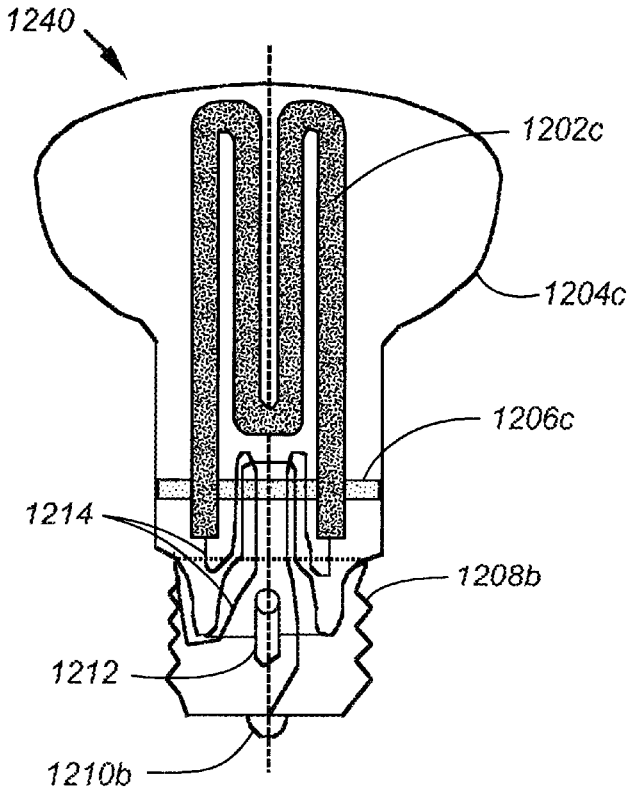
FIG. 3 is a cross-sectional view of a cold cathode gas discharge illumination device to illustrate another embodiment of the invention.

FIG. 3 illustrates yet another configuration of an illumination device which may be used in place of incandescent lamps to fit into conventional spiral-type conventional sockets. Device 1240 differs from device 1220 in the shape of the container 1204*c*. Other than such difference, device 1240 is essentially the same as device 1220.

Figure 4:
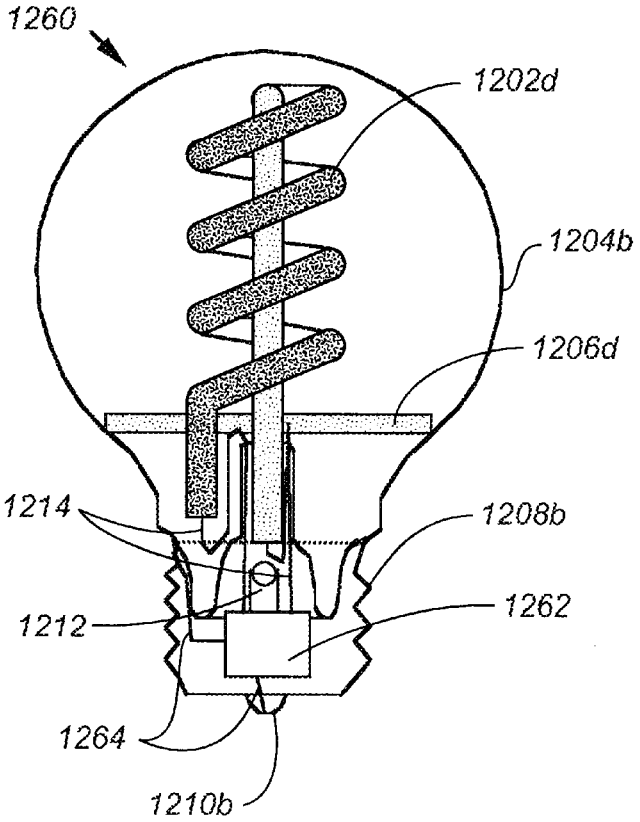
FIG. 4 is a schematic view of a cold cathode gas discharge illumination device employing a spiral-shaped CCFL and a driver for converting 50 or 60 cycle power to higher frequency power to illustrate yet another embodiment of the invention.

FIG. 4 is a schematic view of another illumination device 1260 to illustrate another embodiment of the invention. The same as devices 1220, 1240, device 1260 is adapted to replace incandescent lamps and would fit into conventional spiral-type sockets without having to change the socket configuration. Device 1260 differs from device 1220 in the following respects. The CCFL 1202*d* has a spiral shape rather than a "M" shape as in devices 1220, 1240 of FIGS. 2, 3. Furthermore, device 1260 includes a driver 1262. CCFLs typically operate at a higher frequency than the 60 or 50 cycles per second AC that is normally provided by power companies. For this purpose, it is preferable to include a driver 1262 in the illumination device 1260 which can convert a 50 or 60 cycle frequency AC provided by the power company into the desired operating frequency preferably in a range of about 30 to 50 kHz for operating the CCFL. By providing a driver 1262 as an integral part of the illumination device 1260, the voltage supplied to connectors 1210*b* and the other electrical connector on the outside spiral surface of lamp holder 1208*b* need not be first converted to a high frequency signal, so that illumination device 1260 may be directly installed into a conventional electrical socket, without requiring any change in the 50 or 60 Hz AC power supplied by power companies. Electrical connectors such as wires 1264 connect driver 1262 to electrical connectors 1210*b* and that on the spiral surface of lamp holder 1208*b*. Electrical connectors such as wires 1214 connect the driver 1262 to the CCFL 1202*d*.

Figure 5:
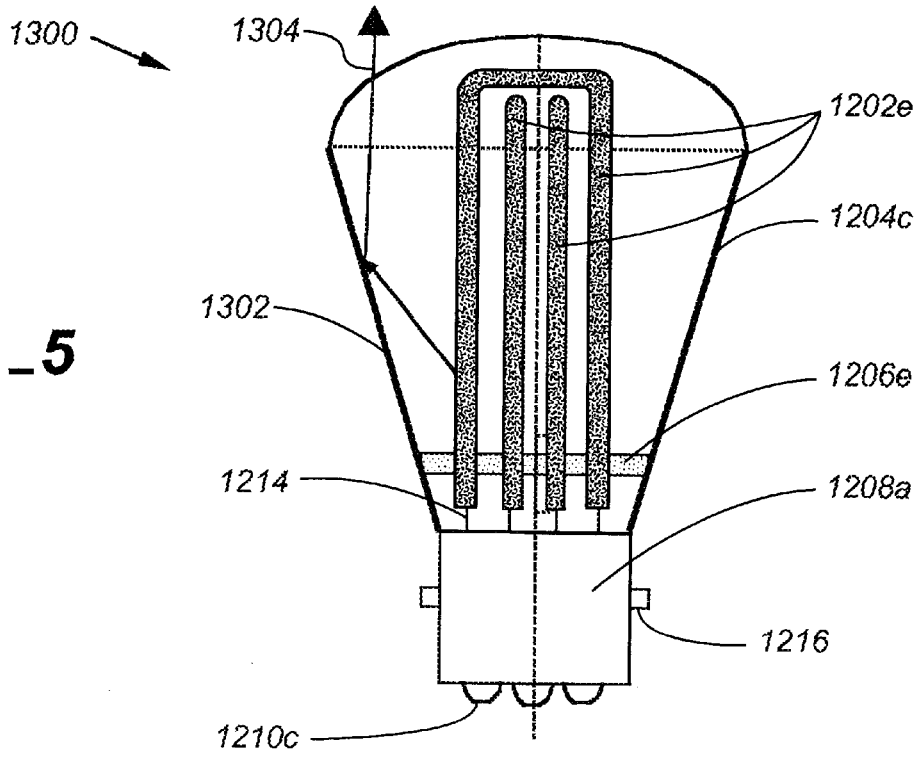
FIG. 5 is a cross-sectional view of a cold cathode gas discharge illumination device employing three CCFLs for displaying red, green and blue light to illustrate one more embodiment of the invention.

FIG. 5 illustrates another illumination device 1300 comprising three "U" shaped CCFLs 1202*e*, such as one CCFL for displaying red light, one for displaying green light and the remaining one for displaying blue light, so that device 1300 may be used for displaying images. The "U" shape of the CCFL is apparent for only one of the CCFLs, the other two CCFLs being viewed from the side so that their "U" shape is not apparent from FIG. 5. The three CCFLs 1202*e* are housed in a container 1204*c* which has a generally spherical top portion and a substantially conical bottom portion. The inner wall of the conical portion of the container 1204*c* is provided with a reflective film 1302 to reflect a ray 1304 of light from the CCFL towards a viewer (not shown). A pair of electrical connectors 1210*c* is provided for each of the three CCFLs, so that the three CCFLs may be individually controlled. In this manner, illumination device 1300 may be controlled to display red, green or blue light either by itself, or together in any combination.

Figure 6:
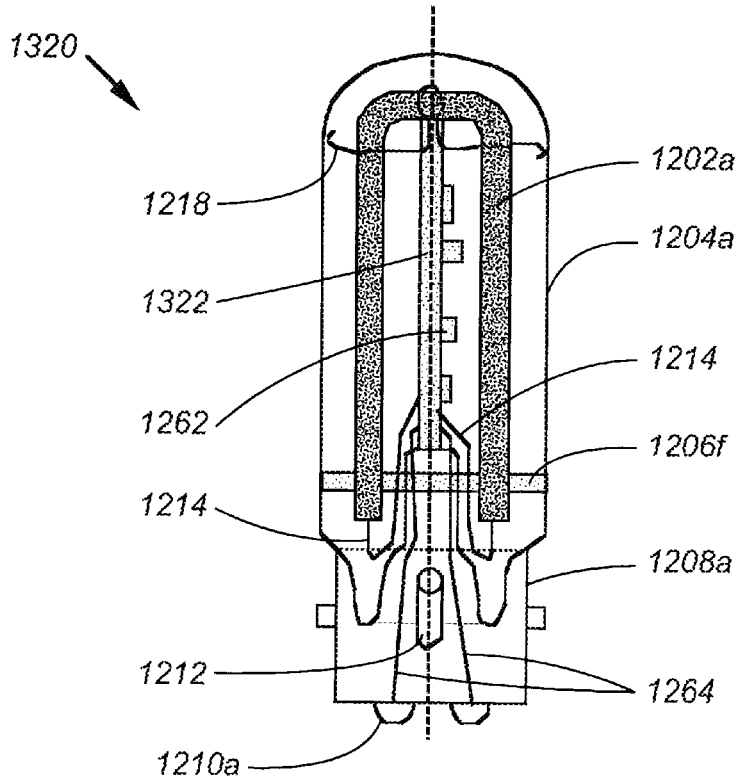
FIG. 6 is a schematic view of a cold cathode gas discharge illumination device where a printed circuit board and a driver are employed for supplying power to the CCFL.

FIG. 6 is a schematic view of illumination device 1320 to illustrate another embodiment of the invention. Device 1320 is similar to device 1200 of FIG. 1 in many respects and differs from device 1200 in that a substrate 1322, such as a printed circuit board, is placed in the container 1204*a* for supporting a driver 1262 which performs the same function as that described above for device 1260 of FIG. 4, whereby the driver converts the 50 or 60 Hz AC power from the power company to a high frequency AC signal suitable for operating CCFLs. Electrical wires 1214 connect driver 1262 to the CCFL 1202*a* and electrical wires 1264 connect the driver 1262 to electrical connectors 1210*a*. The printed circuit board and the driver preferably have light reflective surfaces to optimize light emitted by the devices 1320 and 1260.

Figure 7:
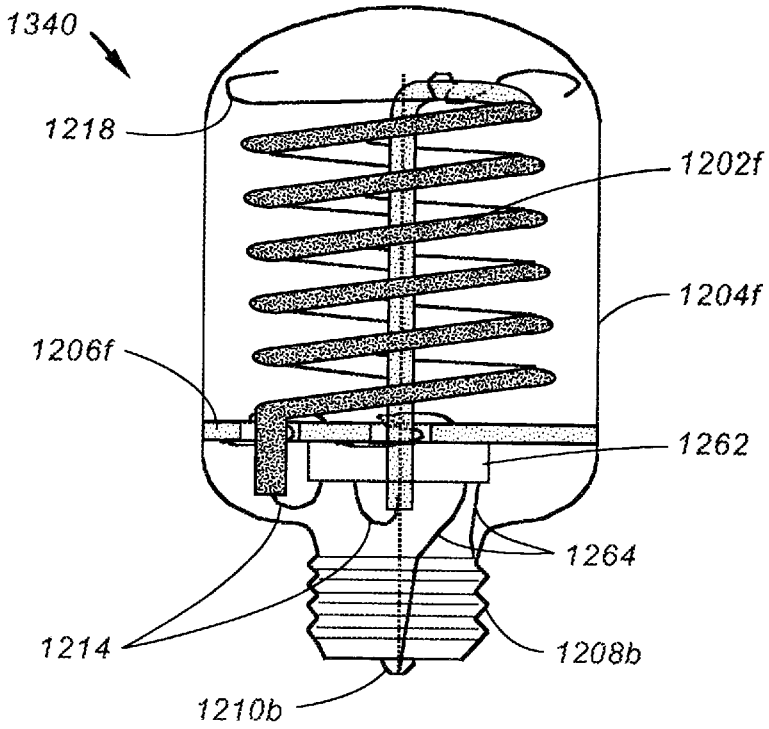
FIG. 7 is a schematic view of a cold cathode gas discharge illumination device employing a spiral-shaped CCFL with support means and driver to illustrate yet another embodiment of the invention.

FIG. 7 is a schematic view of yet another illumination device 1340 to illustrate another embodiment of the invention. Spiral shaped CCFL 1202*f* is housed in a container 1204*f* which is generally cylindrical in shape. Spring 1218 is connected to a portion of the CCFL intermediate between the two ends of the CCFL and inner walls of the container to stabilize the position of the CCFL in the container, so that vibrations of device 1340 will not cause the CCFL to be subject to inordinate strain or hit the container. The two ends of the CCFL are inserted into matching holes in the base plate 1206*f* and a driver 1262 is used for converting the 50 or 60 Hz AC from the power company to a higher frequency power for the CCFL. The electrical connections connecting the CCFL, driver, and electrical connectors in FIG. 7 are similar to those described above for FIG. 4.

Figure 8:
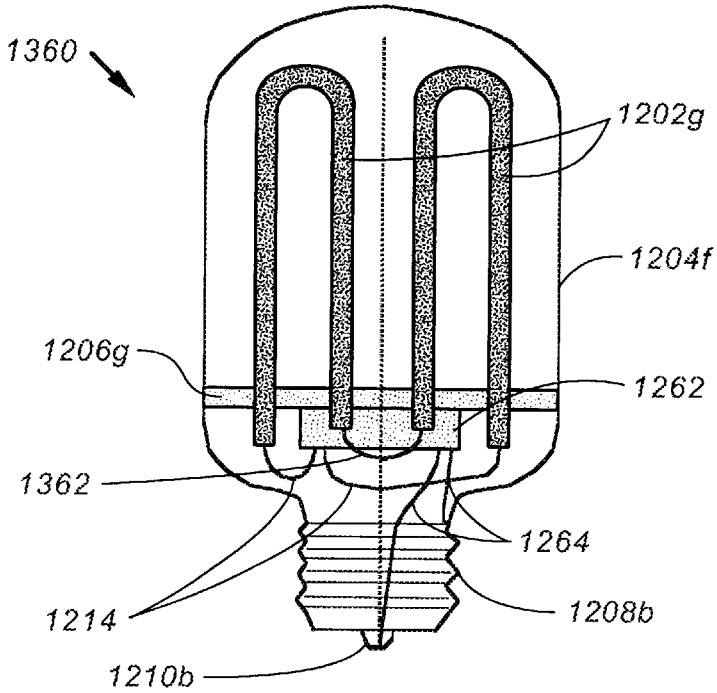
FIG. 8 is a schematic view of a cold cathode gas discharge illumination device employing a double "U"-shaped CCFL to illustrate an embodiment of the invention.

FIG. 8 is a schematic view of another illumination device 1360 to illustrate yet another embodiment of the invention. Device 1360 includes two "U"shaped CCFLs, whose two ends are inserted into matching holes in base plate 1206*g* for holding the CCFLs to the container. The operation of the driver 1262 and the wire connections in device 1360 are similar to those described above for device 1340, except that the two CCFLs are connected by an additional wire 1362.

Figure 9A:
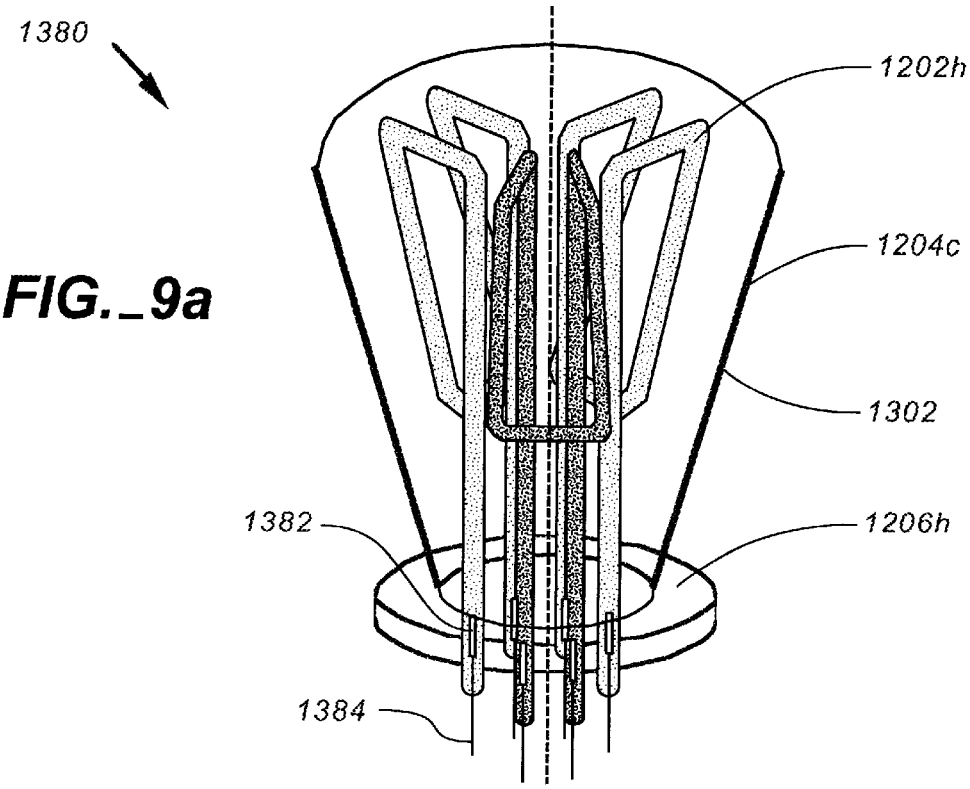
FIG. 9(*a*) is a perspective view of a cold cathode gas discharge illumination device to illustrate one more embodiment of the invention.
Figure 9B:
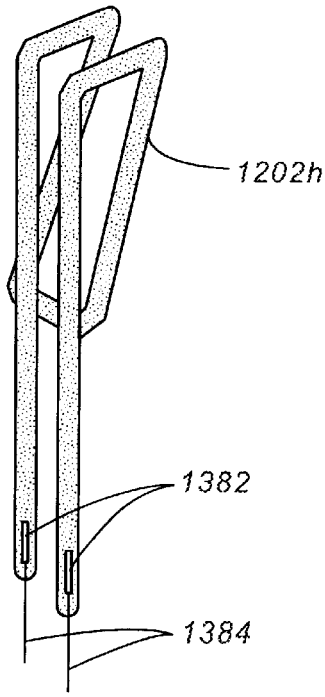
Figure 9C:
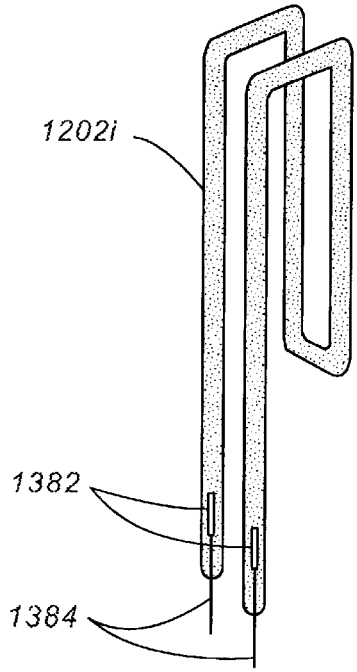

FIG. 9(*a*) is a perspective view of a cold cathode gas discharge apparatus 1380 to illustrate an embodiment of the invention. A container 1204*c* is used for housing three CCFLs 1202*h*, where the container is substantially the same as that used in FIG. 5. Where discharge device 1380 is used with a narrow viewing angle from the top of the device, a light-reflective layer 1302 may be employed on the inner or outer surface of the container to refract light toward the viewing direction in the same manner as shown in FIG. 5. Where device 1380 is used for illumination, by emitting light in substantially all directions, such reflective layer may be omitted. Container 1204*c* is sealingly attached to and sitting on a base plate 1206*h* and each of the three CCFLs 1202*h* has two ends that are inserted through matching holes in the base plate, so that the electrodes 1382 located at the ends of the CCFLs are outside the sealed or enclosed chamber in container 1204*c*. The connectors 1382 are connected to a power supply (not shown) through wires 1384. The base plate 1206*h* may be connected to a lamp holder of the two-pronged type 1208*a* or the spiral-type 1208*b* shown in FIGS. 1–8. Wires 1384 may be connected to electrical connectors of the two-prong or spiral-type connectors in the same manner as that shown in FIGS. 1–8, where the lamp holder may or may not include driver 1262. Where a plurality of discharge devices 1380 are arranged in a two-dimensional array for displaying characters and graphic images, the base plate 1206*h* may be connected to a module holder housing.

The CCFLs 1202*h* have a shape shown more clearly in FIG. 9(*b*). Since the amount of light generated by the CCFL is proportional to the length of the CCFL that can be held within a given volume, it is preferable to employ a CCFL comprising two parallel elongated tubes connected at the end to form a loop, and where the parallel tubes are bent back towards itself to increase the length of the CCFL within the container.

FIG. 9(*c*) is a perspective view of another CCFL 1202*i* having a shape that is essentially the same as 1242*h* but does not bend towards itself to the extent that is the case in 1202*h*. Obviously, other shapes of CCFLs obtained by bending two parallel tubes connected at the end into various shapes may be employed and are within the scope of the invention.

In the operation of the CCFL, a relatively high voltage is applied to the CCFL. For this reason, typically a significant voltage drop develops across the electrodes connected to the CCFL. Such heat generated is proportional to the voltage drops across the electrodes, large voltage drops may cause significant heat to be generated at the electrodes. As noted above, CCFLs have higher luminous efficiency and longer lifetimes if operated at an elevated temperature, such as a temperature in the range of about 30–75° C. For this reason, the CCFL is placed in an enclosed chamber to reduce heat loss and to maintain the elevated temperature of the CCFL, where the chamber is evacuated or filled with a gas such as nitrogen or an inert gas. Thus, if the electrode for applying a voltage to the CCFL is within the enclosed chamber, the heat generated by the electrode may cause the temperature of the CCFL to rise to above its optimal operating temperature range. For this reason, it may be desirable to place the electrode outside the enclosed chamber in the manner shown in FIG. 10.

Figure 10:
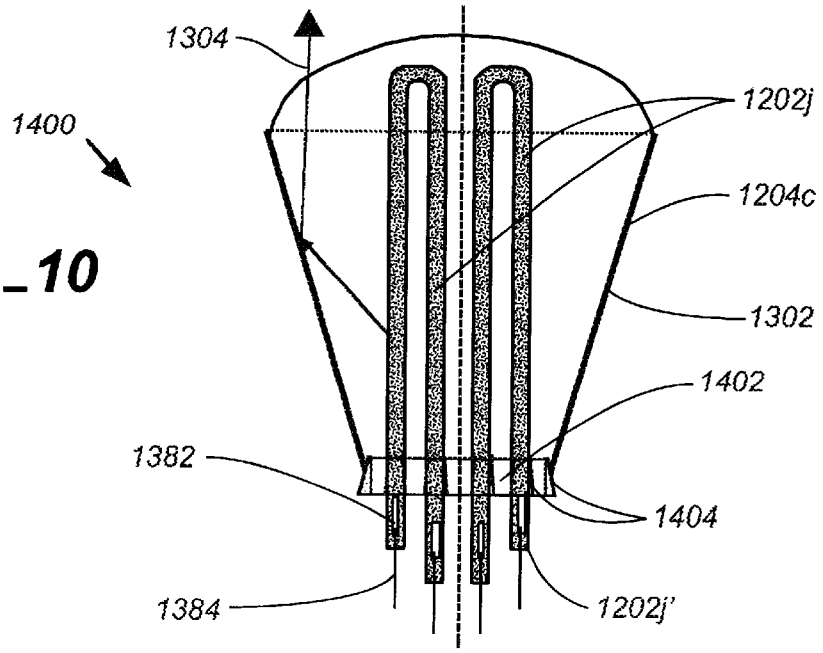
FIG. 10 is a schematic view of a cold cathode gas discharge illumination device where one or more of the electrodes for applying voltages to the CCFLs are placed outside of the chambers containing the CCFLs to facilitate heat dissipation.

In reference to FIG. 10, the CCFLs 1202*j* have ends 1202*j*' which extend through a support plate 1402, preferably made of glass, ceramic or plastic, so that these ends are outside the chamber enclosed by container 1204*c*. As shown in FIG. 10, each of the ends 1202*j*' of the CCFLs is provided with an electrode 1382 connected to a power supply (not shown) through a wire 1384. A glass frit or adhesive (e.g, silicone glue) 1404 is used to attach the CCFL 1202*j* to the surfaces of the matching holes in the bottom support plates 1402. Thus, the electrodes 1382 at the four ends 1202*j*' are all outside the chamber enclosed by container 1204*c*, so that the heat generated at such electrodes will dissipate in the environment without causing the temperature of the CCFLs in the enclosed chamber to rise above the desired operating temperature range. Of course, not all the ends of the CCFL's need to be outside the container; such and other variations are within the scope of the invention.

One of the problems encountered in the CCFL design is that luminous efficiency of the CCFL is the highest when its diameter is of the order of 2 millimeters. However, a CCFL having a uniform tube with such diameter could employ only very small electrodes. Small electrodes have small surface areas. The brightness of the CCFL depends on the quantity of electrons that are generated by the electrodes. The amount of electrons generated in the tube depends on the surface area of the electrode, so that the larger the surface area the larger is the quantity of electrons generated. If the electrodes have small surface areas, only a small quantity of electrons may be generated for causing light emission. Therefore, small electrodes limit the intensity of light that can be generated.

Furthermore, the boundary between the electrode and the gas medium inside the CCFL tube has an electrical resistance. The electrical resistance across such interface would be larger for small electrodes compared to large electrodes. Given a set value of the current through the CCFL, the amount of power that is transformed into heat by the CCFL is proportional to the electrical resistance at the interface, so that smaller electrodes would cause higher power dissipation and raise the temperature of the CCFL. At high temperature, the glass material of the CCFL tube may outgas and/or decompose, thereby causing the CCFL to be less durable and to have a shorter lifetime. Moreover, with small tube CCFL's, the spacings between the electrodes and the tube material are also small, which enhances heat transfer from the electrodes to the tube material, thereby aggravating the outgassing and decomposition problem.

Figure 11A:
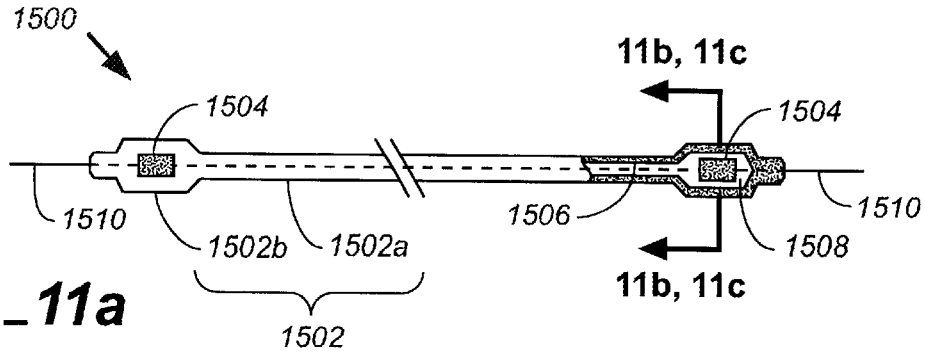
FIG. 11(*a*) is a cross-sectional view of a CCFL to illustrate another embodiment of the invention.
Figure 11B:
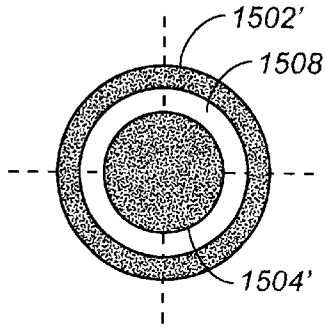
Figure 11C:
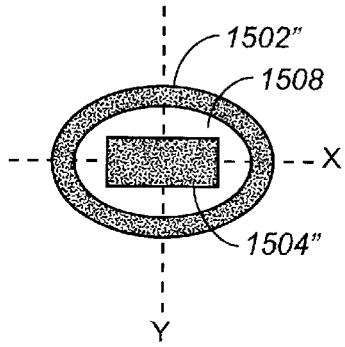

FIG. 11(*a*) is a cross-sectional view of a CCFL to illustrate another embodiment of the invention. FIGS. 11(*b*), 11(*c*) are respectively cross-sectional views along the line 11(*b*), 11(*c*) –11(*b*), 11(*c*) in FIG. 11(*a*), illustrating two different implementations of the embodiment of FIG. 11(*a*).

To overcome the above-described shortcomings, applicants propose a CCFL design shown in FIG. 11(*a*). As shown in FIG. 11(*a*), CCFL 1500 includes a tube 1502 comprising an elongated portion 1502*a* and preferably two enlarged portions 1502*b*. The cross-sectional dimensions (e.g. diameter) of the elongated portion 1502*a* is preferably of a value to enhance the efficiency of the CCFL 1500. For example, the cross-sectional dimensions of the elongated portion 1502*a* may be in the range of 1–8 millimeters and preferably in the range of 24 millimeters. The enlarged portions 1502*b* would accommodate larger size electrodes 1504 that would not fit within the elongated portion 1502(*a*). Thus, the cross-sectional dimensions of the enlarged portions 1502*b* are larger than those of the elongated portion 1502*a* In the preferred embodiment, the cross-sectional dimensions of the enlarged portions 1502*b* is up to ten times those of the elongated portion 1502*a*.

With the above-described design shown in FIG. 11(*a*), electrodes 1504 may be enlarged to provide more surface area for the emission of electrons and to reduce the resistance across the boundaries between the electrode and the medium in the tube 1502. This increases the amount of electrons generated by the electrodes and therefore the overall brightness of the CCFL 1500. The lower resistance across the electrodes/medium boundary also reduces the amount of heat generated and therefore the overall temperature of the CCFL 1500. The electrodes may also be spaced further apart from the enlarged tube portions 1502*b* to reduce the amount of heat transferred to the tube. The resulting lower temperature of the tube material (e.g. glass) of CCFL 1500 during operation reduces the out gassing by and decomposition of the glass material of the tube 1502, thereby increasing the lifetime of the CCFL 1500.

The inside surface of the tube 1502 is coated with a layer of luminescent material 1506 such as phosphor. When electrons generated by the electrodes 1504 collide with mercury atoms in tube 1502, the mercury atoms may be caused to be in an excited state. When mercury atoms in the excited state fall back to a lower energy state, they emit ultraviolet light. When such ultraviolet light impinges on the layer of luminescent material 1506, such material emits visible light for illumination and display purposes. Electrical wires 1510 supply power and electrical current to the electrodes 1504 to cause the electrodes to emit electrons.

Tube 1502 defines therein a chamber 1508 housing an inert gas such as argon or xenon and mercury. The enlarged portion of tube 1502 may have an annular cross-section 1502*b*' and electrodes 1504 may have annular or circular cross-sections 1504', where the annular shape of tube 1502 and circular shape of electrodes 1504 are as shown in FIG. 11(*b*). Alternatively, in order to reduce the thickness of the CCFL for applications such as flat panel displays, it may be desirable to employ a tube 1502" that has an elliptical cross-section and electrodes 1504" that have flat cross-sections, all as shown in FIG. 11(*c*). In FIG. 11(*c*), electrodes 1504" have flat plate-shaped cross-sections. Tube 1502" may also have "flat shapes" other than elliptical in order to reduce the thickness of the CCFL; thus, in such "flat shapes"the dimension of the tube 1502" along the Y axis is smaller than its dimension along the X axis in reference to FIG. 11(*c*).

While in the preferred embodiment illustrated in FIG. 11(*a*), tube 1502 has two enlarged portions for housing two electrodes, it may be possible to employ a tube with only one enlarged portion for housing two enlarged electrodes, such as a circular tube with an enlarged portion for housing two electrodes, where the two electrodes are separated by an insulating plate or layer within the enlarged portion, so that current will flow between the two electrodes through the circular tube. Such and other variations are within the scope of the invention.

While many CCFLs comprise tubes with a layer of luminescent material such as phosphor on the inside surface of the tube and mercury in the tube for light generation as described above, these two elements are not required, especially for CCFLs generating light of certain colors such as red. To generate light, a CCFL may comprise simply a tube containing electrodes and a suitable gas such as neon or xenon without phosphor or mercury in the tube. An electrical discharge in the tube between the electrodes would cause some of the gas molecules to be excited; when the excited molecules return to lower energy state(s), light is generated.

While the invention has been described above by reference to various embodiments, it will be understood that different changes and modifications may be made without departing from the scope of the invention which is to be defined only by the appended claims and their equivalents.

What is claimed is:

1. A cold cathode fluorescent lamp comprising:

two electrodes;

a tube having an elongated portion with cross-sectional dimensions, and at least one enlarged portion with cross-sectional dimensions greater than those of the elongated portion for housing the two electrodes;

an inert gas in the tube;

means for applying an electric current to the two electrodes to cause gas discharge in the tube for generating light.

2. The lamp of claim 1, said at least one elongated portion of the tube having cross-sectional dimensions in a range of about 1 to 8 mm.

3. The lamp of claim 1, said cross-sectional dimensions of the at least one enlarged portion being up to about 10 times those of the elongated portion.

4. The lamp of claim 1, wherein each of said at least one enlarged portion and said at least one electrode has a substantially annular or circular cross-section.

5. The lamp of claim 1, wherein said at least one enlarged portion has a cross-section that has different dimensions along two transverse axes, and said two electrodes have substantially flat cross-sections.

6. The lamp of claim 5, wherein said at least one enlarged portion has a substantially elliptical cross-section.

7. The lamp of claim 1, said tube having two enlarged portions, each enlarged portion housing one of the two electrodes.

8. The lamp of claim 1, further comprising a layer of luminescent material on an inside surface of the tube and mercury in the tube.

9. A cold cathode fluorescent lamp comprising:

two electrodes;

a tube having an elongated portion with cross-sectional dimensions, and at least one enlarged portion with cross-sectional dimensions greater than those of the elongated portion for housing at least one of the two electrodes;

an inert gas in the tube;

electrical connectors applying an electric current to the two electrodes to cause gas discharge in the tube for generating light.

10. The lamp of claim 9, said at least one elongated portion of the tube having cross-sectional dimensions in a range of about 1 to 8 mm.

11. The lamp of claim 9, said cross-sectional dimensions of the at least one enlarged portion being up to about 10 times those of the elongated portion.

12. The lamp of claim 9, wherein each of said at least one enlarged portion and said at least one electrode has a substantially annular or circular cross-section.

13. The lamp of claim 9, wherein said at least one enlarged portion has a cross-section that has different dimensions along two transverse axes, and said two electrodes have substantially flat cross-sections.

14. The lamp of claim 13, wherein said at least one enlarged portion has a substantially elliptical cross-section.

15. The lamp of claim 9, said tube having two enlarged portions, each enlarged portion housing one of the two electrodes.

16. The lamp of claim 9, further comprising a layer of luminescent material on an inside surface of the tube and mercury in the tube.

* * * * *